US010588475B2

(12) United States Patent
Koura et al.

(10) Patent No.: US 10,588,475 B2
(45) Date of Patent: Mar. 17, 2020

(54) SELF-PROPELLED DUST-COLLECTING ROBOT AND REFLECTION MEMBER, AND METHOD FOR CONTROLLING RUNNING OF SELF-PROPELLED DUST-COLLECTING ROBOT

(71) Applicant: MAKITA CORPORATION, Anjo-shi, Aichi (JP)

(72) Inventors: Kentaro Koura, Anjo (JP); Yasutoshi Shinma, Anjo (JP)

(73) Assignee: MAKITA CORPORATION, Anjo (JP)

( * ) Notice: Subject to any disclaimer, the term of this patent is extended or adjusted under 35 U.S.C. 154(b) by 282 days.

(21) Appl. No.: 15/277,157

(22) Filed: Sep. 27, 2016

(65) Prior Publication Data

US 2017/0112344 A1 Apr. 27, 2017

(30) Foreign Application Priority Data

Oct. 27, 2015 (JP) ..... 2015-211128

(51) Int. Cl.
*A47L 9/00* (2006.01)
*A47L 11/40* (2006.01)
(Continued)

(52) U.S. Cl.
CPC ..... *A47L 11/4011* (2013.01); *A47L 9/009* (2013.01); *A47L 9/102* (2013.01); *A47L 9/28* (2013.01);
(Continued)

(58) Field of Classification Search
CPC .... A47L 11/4011; A47L 9/009; A47L 9/2857; A47L 9/2826; A47L 9/102; A47L 9/2884;
(Continued)

(56) References Cited

U.S. PATENT DOCUMENTS 8,781,627 B2 * 7/2014 Sandin ..... G05D 1/0225 700/258
8,978,196 B2 * 3/2015 Svendsen ..... A47L 5/30 15/319
(Continued)

FOREIGN PATENT DOCUMENTS

JP 2006-095107 A 4/2006
JP 2013-144022 A 7/2013
(Continued)

OTHER PUBLICATIONS

May 14, 2019 Office Action issued in Japanese Patent Applicaiton No. 2015-211128.
(Continued)

*Primary Examiner* — Jason Holloway
(74) *Attorney, Agent, or Firm* — Oliff PLC

(57) ABSTRACT

A self-propelled dust-collecting robot includes a main body having wheels, a dust-collecting unit collecting dust on a floor surface, infrared sensors each including an infrared transmission element that emits infrared light toward the floor surface and an infrared reception element that receives the infrared light reflected at the floor surface, and a controller controlling the wheels on the basis of a reflectance of the infrared light obtained from each infrared sensor. The controller, during running, determines whether the reflectance is higher than or equal to a predetermined threshold value. Upon determining that the reflectance is higher than or equal to the threshold value, the controller controls the wheels to perform an avoidance action with the position where the reflectance is detected being a virtual wall, thereby to control the self-propelled dust-collecting robot to perform cleaning within a cleaning range defined by a reflection member.

13 Claims, 10 Drawing Sheets

(51) Int. Cl.
*A47L 9/28* (2006.01)
*A47L 9/10* (2006.01)

(52) U.S. Cl.
CPC ..... *A47L 9/2826* (2013.01); *A47L 9/2852* (2013.01); *A47L 9/2857* (2013.01); *A47L 9/2884* (2013.01); *A47L 11/4008* (2013.01); *A47L 11/4013* (2013.01); *A47L 11/4038* (2013.01); *A47L 11/4041* (2013.01); *A47L 2201/00* (2013.01); *A47L 2201/04* (2013.01)

(58) Field of Classification Search
CPC ..... A47L 9/2852; A47L 9/28; A47L 11/4038; A47L 11/4041; A47L 11/4008; A47L 11/4013; A47L 2201/00; A47L 2201/04; A47L 9/2805; B25J 11/0085
See application file for complete search history.

(56) References Cited

U.S. PATENT DOCUMENTS 9,280,158 B2 * 3/2016 Bron ..... G05D 1/0225
2006/0020370 A1 1/2006 Abramson
2010/0332067 A1 * 12/2010 Abramson ..... A47L 5/22 701/23
2011/0040437 A1 * 2/2011 Lynch ..... G05D 1/0242 701/23
2013/0206170 A1 * 8/2013 Svendsen ..... A47L 5/30 134/6
2014/0188325 A1 * 7/2014 Johnson ..... G05D 1/0227 701/26
2015/0042485 A1 * 2/2015 Suessemilch ..... G03B 21/2093 340/815.4
2016/0375592 A1 * 12/2016 Szatmary ..... B25J 5/00 700/255

FOREIGN PATENT DOCUMENTS

JP 2015-108736 A 6/2015
WO 2014/032569 A1 3/2014

OTHER PUBLICATIONS

Sep. 12, 2019 Office Action issued in Japanese Patent Application No. 2015-211128.

* cited by examiner

SELF-PROPELLED DUST-COLLECTING ROBOT AND REFLECTION MEMBER, AND METHOD FOR CONTROLLING RUNNING OF SELF-PROPELLED DUST-COLLECTING ROBOT

BACKGROUND OF THE INVENTION

This application claims the benefit of Japanese Patent Application Number 2015-211128 filed on Oct. 27, 2015, the entirety of which is incorporated by reference.

FIELD OF THE INVENTION

The present invention relates to a self-propelled dust-collecting robot which cleans a floor surface while running in a self-propelled manner, a reflection member used for cleaning by the self-propelled dust-collecting robot, and a method for controlling running of the self-propelled dust-collecting robot.

DESCRIPTION OF THE BACKGROUND ART

Conventionally, a self-propelled dust-collecting robot has been known, which runs in a self-propelled manner while wheels are rotationally driven by a built-in motor, and collects dust on a floor surface into a built-in dust box to clean the floor surface. Such a self-propelled dust-collecting robot is disclosed in, for example, Japanese Laid-Open Patent Publication No. 2013-144022. The self-propelled dust-collecting robot runs in a self-propelled manner according to a program, with casters and brushes being driven while acquiring information about a surface to be cleaned by means of an orientation sensor, a floor loss sensor, and the like, and cleans the surface. In particular, the floor loss sensor detects a level difference of a floor by means of two infrared detectors so that the dust-collecting robot can bypass an area where a floor loss is detected.

SUMMARY OF THE INVENTION

When a floor surface of a factory or the like is cleaned by using the self-propelled dust-collecting robot as described above, the dust-collecting robot can detect a level difference of the floor surface, but cannot recognize a cleaning range that is optionally defined when performing cleaning. In this case, the dust-collecting robot does not run in an area to be cleaned, or cleans the same area repeatedly, which results in a reduction of efficiency.

An object of the present invention is to provide a self-propelled dust-collecting robot and a reflection member which enable cleaning within a defined cleaning range, and a method for controlling running of the self-propelled dust-collecting robot.

In order to attain the above-mentioned object, a first aspect of the present invention is a self-propelled dust-collecting robot including a noncontact sensor, in which the noncontact sensor detects a reflection member which is provided on a floor surface to define a cleaning range.

According to a second aspect of the present invention, in the structure of the first aspect, the noncontact sensor may be an infrared sensor having an infrared transmission section and an infrared reception section.

According to a third aspect of the present invention, in the structure of the first aspect, when the reflection member is detected, the self-propelled dust-collecting robot may be controlled to run separately from the reflection member.

According to a fourth aspect of the present invention, the structure of the first aspect may include a control unit configured to control running of the self-propelled dust-collecting robot on the basis of a reflectance of the reflection member which is obtained from the noncontact sensor. The control unit, while the self-propelled dust-collecting robot is running, determines whether the reflectance is higher than or equal to a predetermined threshold value. When the control unit has determined that the reflectance is higher than or equal to the predetermined threshold value, the control unit controls the self-propelled dust-collecting robot to run separately from the reflection member, regarding a detection position of the reflectance as a virtual wall.

According to a fifth aspect of the present invention, in the structure of the fourth aspect, the determination that the reflectance is higher than or equal to the threshold value may be made when a predetermined time period has elapsed from the detection of the reflection member.

According to a sixth aspect of the present invention, in the structure of the third aspect, the running control for making the self-propelled dust-collecting robot separate from the reflection member may be as follows. First, the self-propelled dust-collecting robot is retracted from the position where the reflection member is detected. Then, the self-propelled dust-collecting robot is turned at a predetermined angle and advanced.

According to a seventh aspect of the present invention, in the structure of the second aspect, a pair of right and left infrared sensors may be provided at a foremost position on a bottom surface of a main body having a pair of wheels for running.

According to an eighth aspect of the present invention, in the structure of the seventh aspect, the infrared sensors each may include an infrared transmission element facing downward at a front side of the infrared sensor, and an infrared reception element facing downward at a rear side of the infrared sensor.

According to a ninth aspect of the present invention, the structure of the seventh aspect may include, on the bottom surface of the main body, a falling prevention sensor having a lens plate on a detection surface facing downward, and a side brush that includes a plurality of radially-arranged brushes, and rotates. The lens plate may be located at a position where, in a plan view, a part or entirety of the lens plate overlaps a rotation area of the brushes of the side brush.

According to a tenth aspect of the present invention, in the structure of the seventh aspect, the main body may have a round box shape in a plan view. The main body may accommodate right and left batteries, right and left wheel motors that are rotationally driven with the batteries being power supplies and allow each of the wheels to singly rotate forward and backward, a fan unit disposed between the batteries, and a dust-collecting box.

According to an eleventh aspect of the present invention, in the structure of the tenth aspect, a pair of right and left casters located directly beneath the respective batteries may be provided on the bottom surface of the main body.

According to a twelfth aspect of the present invention, in the structure of the tenth aspect, the batteries may also be used as power supplies for power tools.

According to a thirteenth aspect of the present invention, in the structure of the seventh aspect, the main body may include a selection button for switching between ON and OFF of detection of the reflection member.

According to a fourteenth aspect of the present invention, in the structure of the first aspect, a reflectance of the reflection member may be twice or more of a reflectance of white.

In order to attain the above-mentioned object, a fifteenth aspect of the present invention is a reflection member provided on a floor surface to define a range of cleaning by the self-propelled dust-collecting robot according to the first aspect.

According to a sixteenth aspect of the present invention, in the structure of the fifteenth aspect, the reflection member may be a tape having a width greater than or equal to 20 mm.

In order to attain the above-mentioned object, a seventeenth aspect of the present invention is a method for controlling running of a self-propelled dust-collecting robot. In the method, a cleaning range is defined on a floor surface by using a reflection member, and the self-propelled dust-collecting robot according to claim 1 is caused to run within the cleaning range.

According to an eighteenth aspect of the present invention, in the structure of the seventeenth aspect, when the reflection member is detected, the self-propelled dust-collecting robot may be separated from the reflection member.

It is noted that the "floor surface" means a place having a flat surface on which the self-propelled dust-collecting robot can perform cleaning while running, irrespective of indoor or outdoor.

According to the present invention, the self-propelled dust-collecting robot runs and performs cleaning within a cleaning range defined by the reflection member.

DESCRIPTION OF THE PREFERRED EMBODIMENTS

Hereinafter, an embodiment of the present invention will be described on the basis of the drawings.

Figure 1:
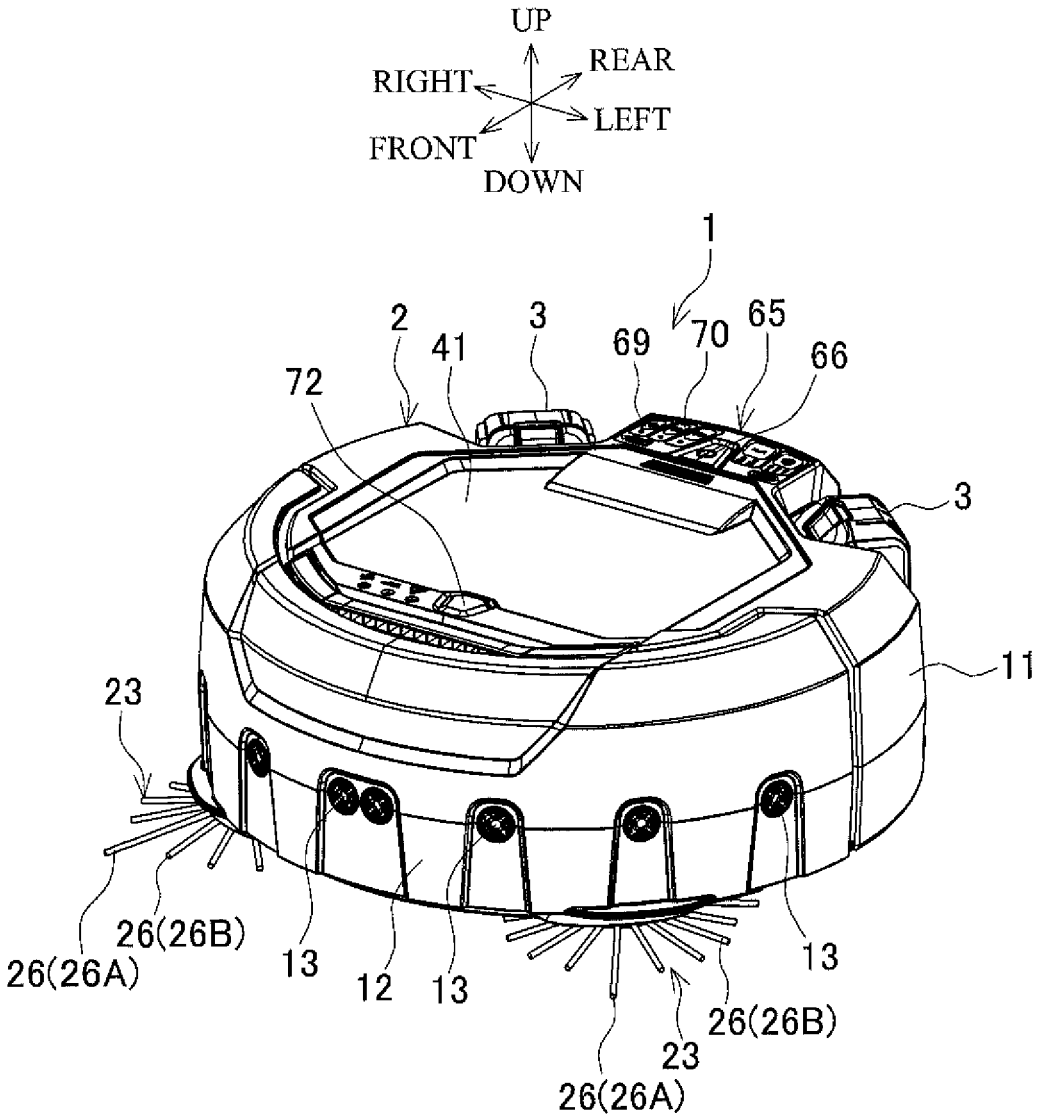
FIG. 1 is a perspective view of a self-propelled dust-collecting robot.
Figure 2:
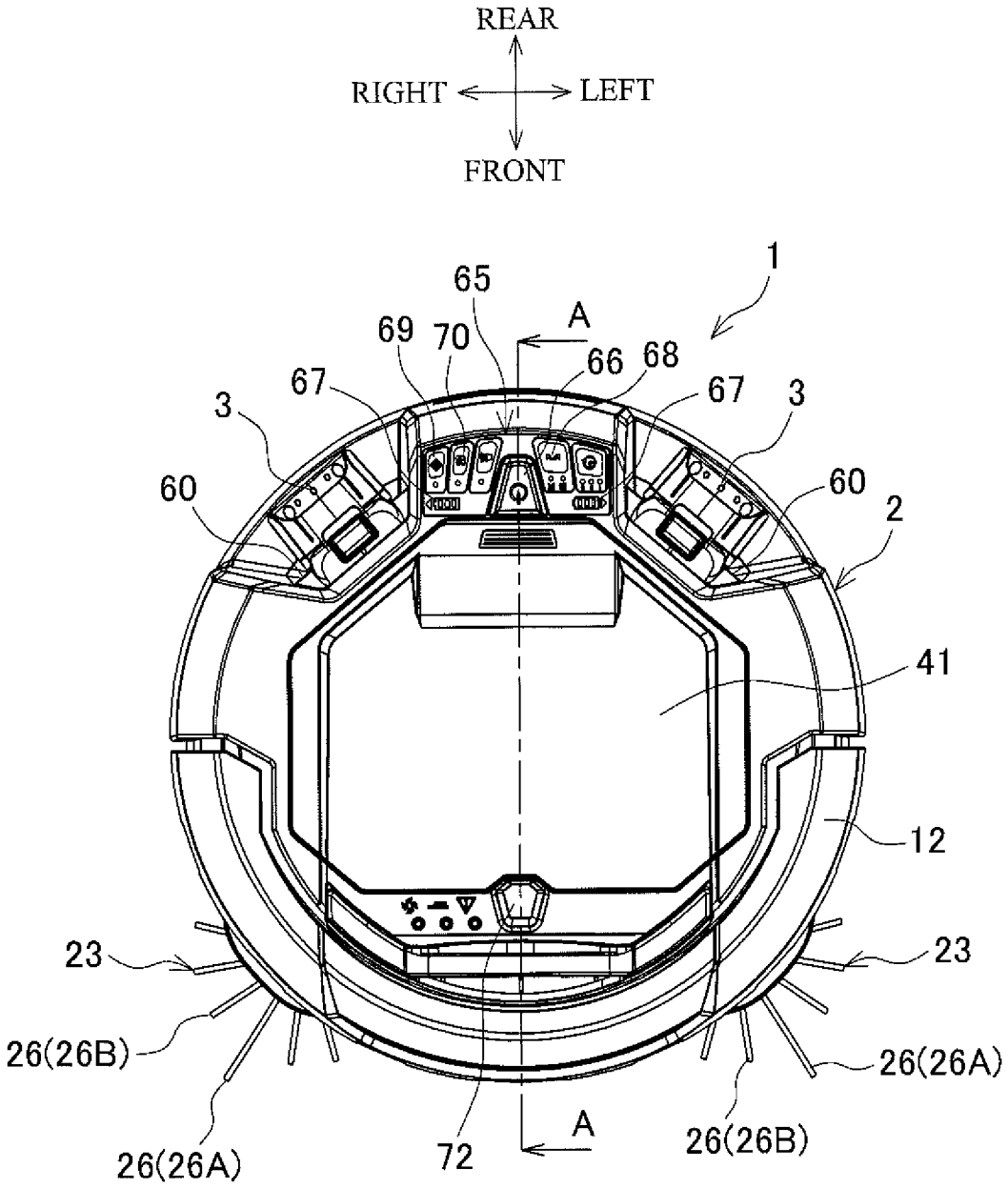
FIG. 2 is a plan view of the self-propelled dust-collecting robot.
Figure 3:
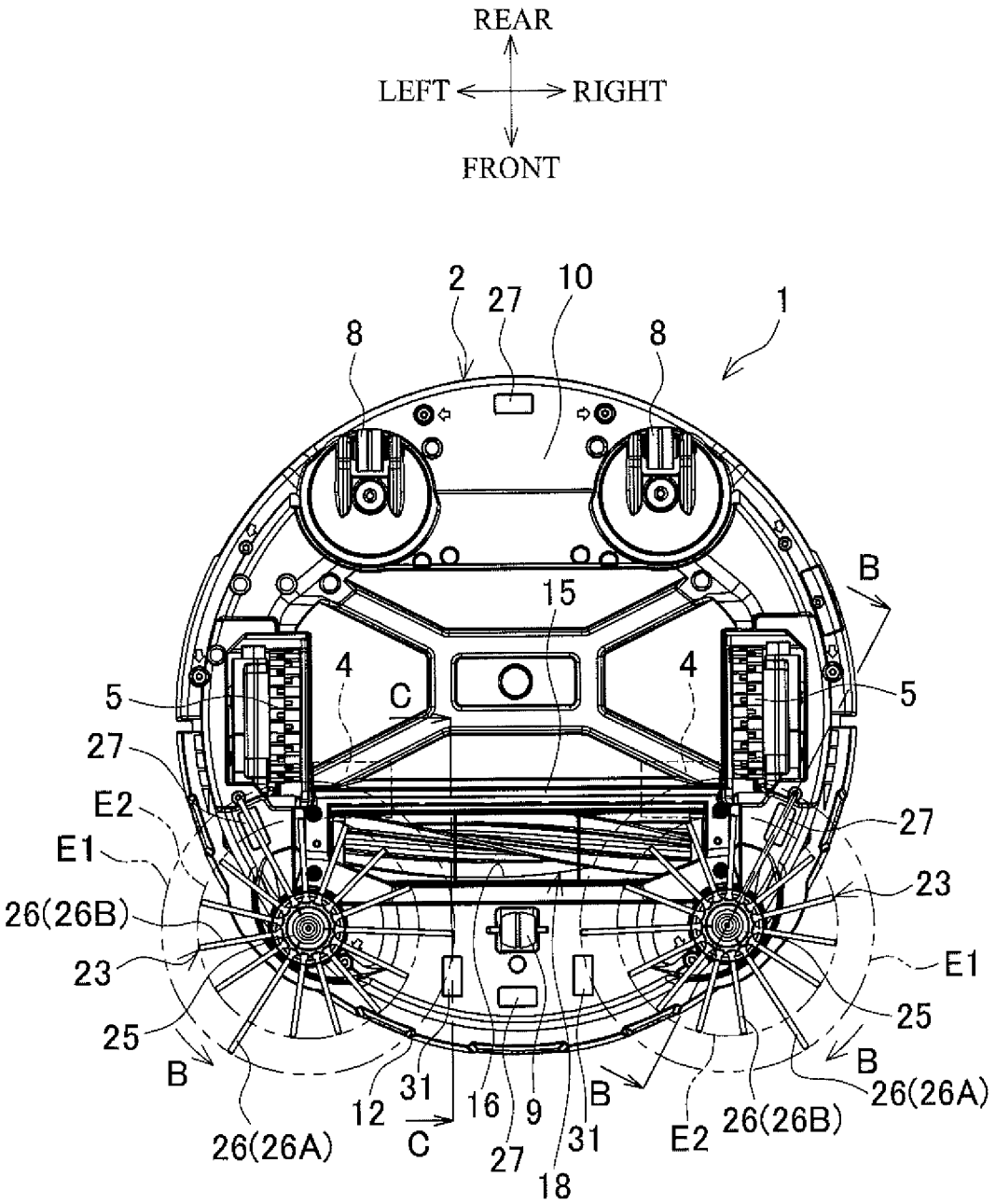
FIG. 3 is a bottom view of the self-propelled dust-collecting robot.
Figure 4:
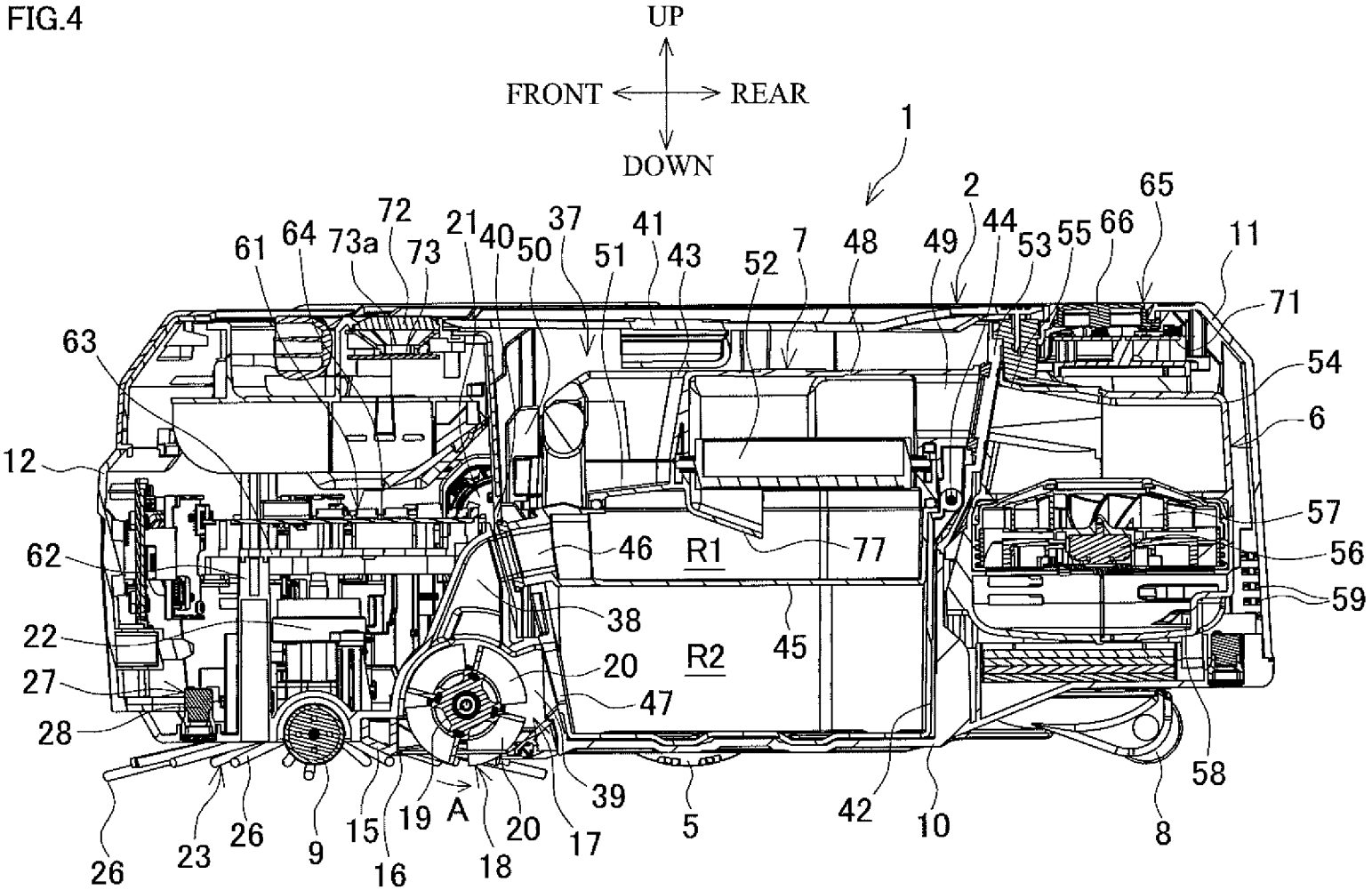
FIG. 4 is an enlarged cross-sectional view taken along a line A-A in FIG. 2.

FIG. 1 is a perspective view showing an example of a self-propelled dust-collecting robot as viewed from above, FIG. 2 is a plan view thereof, FIG. 3 is a bottom view thereof, and FIG. 4 is an enlarged cross-sectional view taken along a line A-A in FIG. 2. The self-propelled dust-collecting robot (hereinafter simply referred to as "dust-collecting robot") 1 includes a box-shaped main body 2 having a circular shape in a plan view. The main body 2 accommodates right and left batteries 3, 3, right and left wheel motors 4, 4 that are rotationally driven with the batteries 3 being power supplies, respectively, a pair of right and left wheels 5, 5 each of which is singly rotatable forward and backward by each wheel motor 4, a fan unit 6 disposed between the batteries 3, 3, and a dust-collecting box 7. The wheels 5, 5 are held in the main body 2 so as to be vertically movable. In the state where the dust-collecting robot 1 is placed on a floor surface, lower portions of the wheels 5 are projected downward from a bottom surface of the main body 2 so that the wheels 5 support the main body 2 floating from the floor surface. A pair of rotatable right and left casters 8, 8 are provided on a rear portion of the bottom surface of the main body 2. A roller 9 that is fixed to face the front and is rollable is provided on a front portion of the bottom surface, at the center in the right-left direction.

The main body 2 includes a lower housing 10 that mainly forms the bottom surface, and an upper housing 11 that is formed from a rear surface toward a top surface and a side surface. On a peripheral surface of a front portion of the main body 2, obstacle sensors 13, 13, . . . are provided in a recessed manner, and a sensor cover 12 is mounted. The obstacle sensors 13 detect, in a noncontact manner, an obstacle in front of the main body 2. The sensor cover 12 moves backward when it contacts an obstacle, and turns on a collision sensor 14 (see FIG. 8).

In a front-side lower portion of the main body 2, a bottom surface cover 15 provided with a suction inlet 16 having a rectangular shape long in the right-left direction is mounted to the lower housing 10 by screws. A brush accommodating space 17 extending in the right-left direction is formed above the suction inlet 16. A main brush is accommodated in the brush accommodating space 17.

The main brush 18 includes a rotation shaft 19 extending in the right-left direction, and a plurality of brushes 20, 20, . . . that are radially and helically implanted on an outer periphery of the rotation shaft 19. The brushes 20 are projected downward from the suction inlet 16. A main brush motor 21 is provided above the brush accommodating space 17, and the main brush 18 is made rotatable in a direction of an arrow A shown in FIG. 4 by a timing belt (not shown) stretched between a left end of the rotation shaft 19 and an output shaft of the main brush motor 21.

Figure 5:
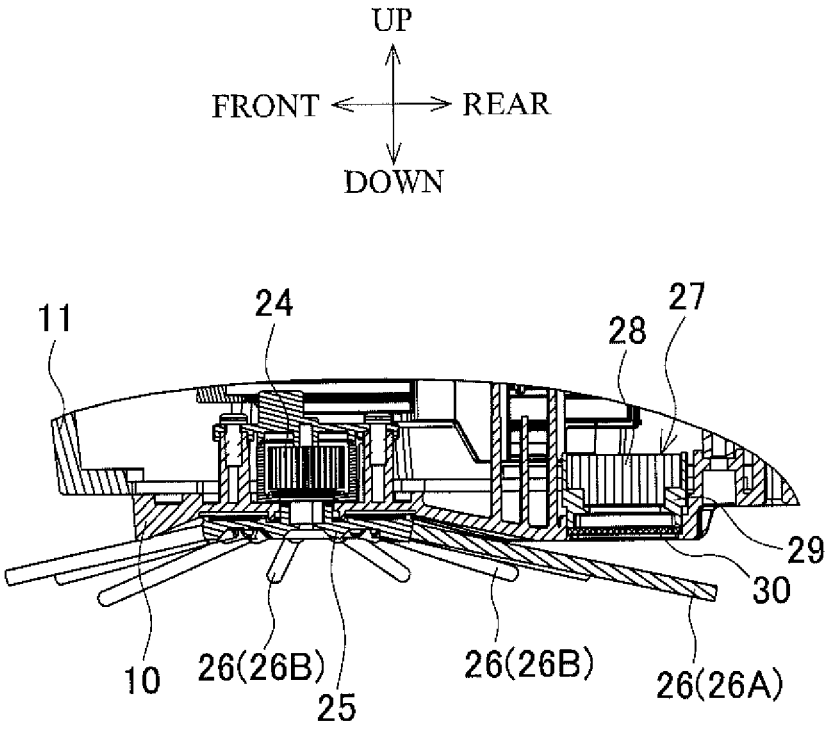
FIG. 5 is a partially-enlarged cross-sectional view taken along a line B-B in FIG. 3.

On the right and left sides of the suction inlet 16, a pair of right and left side brush motors 22, 22 are mounted downward to the lower housing 10, and side brushes 23 that are rotated by the respective side brush motors 22 are provided on the lower housing 10. Each of the side brushes 23 is formed as shown in FIG. 5. Specifically, a disk-like brush base 25 that rotates at the lower side of the lower housing 10 is joined to a lower end of a gear 24 that rotates in engagement with the output shaft of the side brush motor 22. A plurality of brushes 26, 26, . . . for guiding dust into the suction inlet 16 are radially implanted on the brush base 25. Each of the side brushes 23 rotates in a direction of an arrow B shown in FIG. 3. Among the brushes 26, 26, . . . , three brushes 26 (denoted by "26A" for distinction) provided at intervals of 120° are formed to be longer than other brushes 26 (denoted by "26B" for distinction). A major-diameter rotation area E1 is defined by the brushes 26A and a minor-diameter rotation area E2 is defined by the brushes 26B. Both the rotation areas E1 and E2 overlap the suction inlet 16.

On the bottom surface of the main body 2, a plurality of falling prevention sensors 27, 27, . . . for detecting presence/absence of a floor surface are provided. As shown in FIG. 3, four falling prevention sensors 27 in total are provided along an outer periphery of the bottom surface. Specifically, one sensor 27 is provided at a foremost position between the right and left side brushes 23, 23, two sensors 27 are provided to the rear of the right and left side brushes 23, 23, and one sensor 27 is provided at a rearmost position between the right and left casters 8, 8. As shown in FIG. 5, each falling prevention sensor 27 includes a proximity sensor 28, a holder barrel 29 that holds the proximity sensor 28 with a detection surface of the proximity sensor 28 facing downward, and a lens plate 30 that closes a lower surface of the holder barrel 29. In each of the two falling prevention sensors 27, 27 provided to the rear of the right and left side brushes 23, 23, the lens plate 30 is located, in a plan view, within the rotation area E1 defined by the brushes 26A of the brush 23, and is located, in a plan view, so as to partially overlap the rotation area E2 defined by the brushes 26B.

Figure 6:
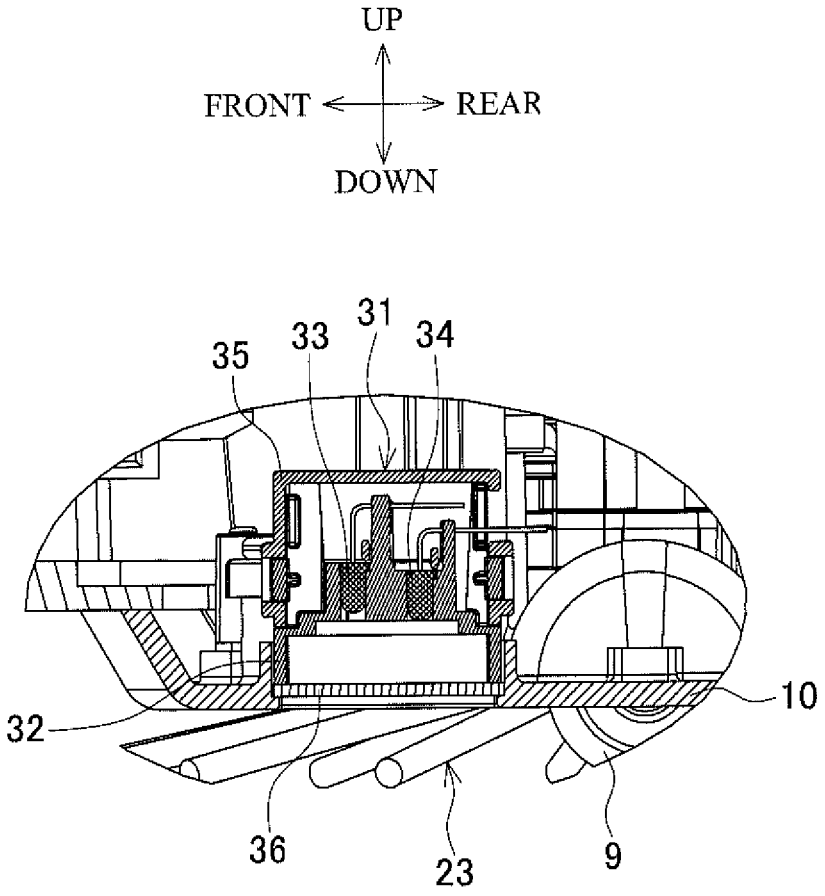
FIG. 6 is a partially-enlarged cross-sectional view taken along a line C-C in FIG. 3.

On the bottom surface of the main body 2, a pair of infrared sensors 31, 31 as noncontact sensors are provided to the right and left of the falling prevention sensor 27 located at the foremost position. As shown in FIG. 6, each infrared sensor 31 includes a holder 32, an infrared transmission element 33, an infrared reception element 34, a cover 35, and a transparent plate 36. The holder 32 has a rectangular tube shape and is mounted to the lower housing 10 such that an opening thereof faces downward and a longitudinal side thereof is along a front-rear direction. The infrared transmission element 33 as a transmission section is held at the front side on a bottom portion of the holder 32 (in FIG. 6, above the opening). The infrared reception element 34 as a reception section is held at the rear side on the bottom portion of the holder 32. The cover 35 covers an upper portion of the holder 32. The transparent plate 36 closes the opening of the holder 32. As the infrared transmission element 33, for example, an infrared LED that emits infrared light at a predetermined frequency (light emission wavelength of 940 nm, for example) is adopted. The infrared transmission element 33 is held by the holder 32 with an emission surface thereof facing downward. As the infrared reception element 34, for example, a module including a photodiode or the like is adopted. The infrared reception element 34 is held by the holder 32 such that a light receiving surface thereof faces downward, and is able to receive the infrared light emitted from the infrared transmission element 33.

Meanwhile, an accommodation unit 37 for the dust-collecting box 7 is recessed with an upper surface thereof being opened in a position to the rear of the main brush 18 in the main body 2. An upper passage 38 and a lower passage 39 are formed in the lower housing 10 in such a manner that the upper passage 38 and the lower passage 39 diverge from the brush accommodating space 17 in the vertical direction and are connected to the accommodation unit 37. The upper passage 38 extends from the upper side of the main brush 18 to a front wall 40 of the accommodation unit 37, and has a rear end opened in the accommodation unit 37. The lower passage 39 extends from the rear side of the main brush 18 to the front wall 40, and has a rear end opened in the accommodation unit 37. Regarding the opening areas of the passages 38 and 39 with respect to the brush accommodating space 17, the opening area of the lower passage 39 is larger than that of the upper passage 38. The upper housing 11 is provided with a lid 41 that opens and closes the upper portion of the accommodation unit 37 to insert and take out the dust-collecting box 7.

The dust-collecting box 7 includes a lower box main body 42, a lid 43 that closes an upper surface of the box main body 42, a hinge 44 at a rear end, which connects the box main body 42 to the lid 43, and a detachable tray 45 that has a shallow plate-like shape and is disposed between the box main body 42 and the lid 43. At a front surface of the tray 45, an upper suction inlet 46 having a horizontally-long rectangular tube shape penetrates the box main body 42 and projects forward so as to be connected to the upper passage 38 in the state where the dust-collecting box 7 is accommodated. At a lower portion of a front surface of the box main body 42, a lower suction inlet 47 is formed along the right-left direction so as to be connected to the lower passage 39 in the state where the dust-collecting box 7 is accommodated. In the above-mentioned state, in the dust-collecting box 7, an upper dust-collecting room R1 is formed above the tray 45 and a lower dust-collecting room R2 is formed beneath the tray 45 so as to be separated from each other.

The lid 43 includes an upper lid 48 that has, at a rear surface thereof, a horizontally-long exhaust tube 49 projecting from the rear surface, and has, at a front surface thereof, a pair of right and left lock plates 50, 50, a lower lid 51 that is fitted to a lower surface of the upper lid 48, and a filter 52 that is sandwiched and held between the upper lid 48 and the lower lid 51. With an operation of sliding the lock plates 50, 50 rightward and leftward, the lid 43 can be locked and released with respect to the box main body 42. Therefore, on the upper side of the tray 45, a ventilation passage is formed such that air introduced from the upper suction inlet 46 into the upper dust-collecting room R1 passes through the inside of the lid 43 via the filter 52 and thereafter is discharged from the exhaust tube 49.

In the rear of a rear wall 53 of the accommodation unit 37, the fan unit 6 is accommodated in the main body 2, and an air inlet 55 provided in an upper front portion of a casing 54 is communicated with the exhaust tube 49 at the position of an opening provided in the rear wall 53. In a lower portion of the casing 54, a suction motor 56 is provided, which includes a rotation shaft and a suction fan 57 mounted on the upper side of the rotation shaft. With rotation of the suction fan 57, air sucked through the air inlet 55 can be discharged from internal air outlets 58, 58, . . . provided in the lower portion of the casing 54. External air outlets 59, 59, . . . are formed in a rear surface of the upper housing 11, outside the internal air outlets 58.

In a rear portion of the upper housing 11, at positions to the right and left of the fan unit 6, mount portions 60, 60 for batteries 3, 3 are formed in a notched shape. The mount portions 60 are arranged symmetrically with respect to a center line of the main body 2 in the front-rear direction. The batteries 3 mounted to the mount portions 60 are lithium ion batteries of 18 V used as power supplies for power tools, and the mount portions 60 have the same structure as mount portions provided in the power tools. Specifically, in an innermost portion of each mount portion 60, a pair of guide rails (not shown) that externally fit to rails formed on a connection portion of each battery 3 are formed upward, and a terminal block having positive and negative terminal plates is provided upward between the guide rails. Therefore, when the battery 3 is inserted into the mount portion 60 from above, the rails of the battery 3 are fitted and connected to the guide rails, and the terminal block is electrically connected to a connection terminal provided on the connection portion of the battery 3. As described above, since the batteries 3 for power tools are used as power supplies, it is not necessary to prepare different batteries for different models, whereby versatility is achieved, and the cost and labor for management are suppressed.

The mount portions 60, 60 are formed to be angled with respect to the front-rear direction so that the innermost surfaces to which the batteries 3, 3 are connected are along the tangent direction of the main body 2, whereby the batteries 3, 3 face the center of the main body 2 when mounted to the mount portions 60, 60. Since the batteries 3 are angled and radially mounted as described above, the batteries 3 can be arranged outermost along the outer shape of the main body 2. Thus, an unnecessary space is not formed between each battery 3 and the outer periphery of the main body 2.

Further, since the batteries 3 are arranged in a well-balanced manner to the right and the left with respect to the center line of the main body 2 in the front-rear direction, no deviation of the center of gravity occurs even though the two batteries 3 are provided. In particular, since the casters 8, 8 are positioned directly beneath the mounted batteries 3, 3, stability during running is good, and straightness in running is not deteriorated even if one of the batteries 3 is not mounted.

Meanwhile, in FIG. 4, reference numeral 61 denotes a controller as a control unit provided between the right and left side brush motors 22, 22. The controller 61 includes a support base 63 supported by a boss 62 disposed upright on the lower housing 10, and a control circuit board 64 fixed on the support base 63.

Figure 7:
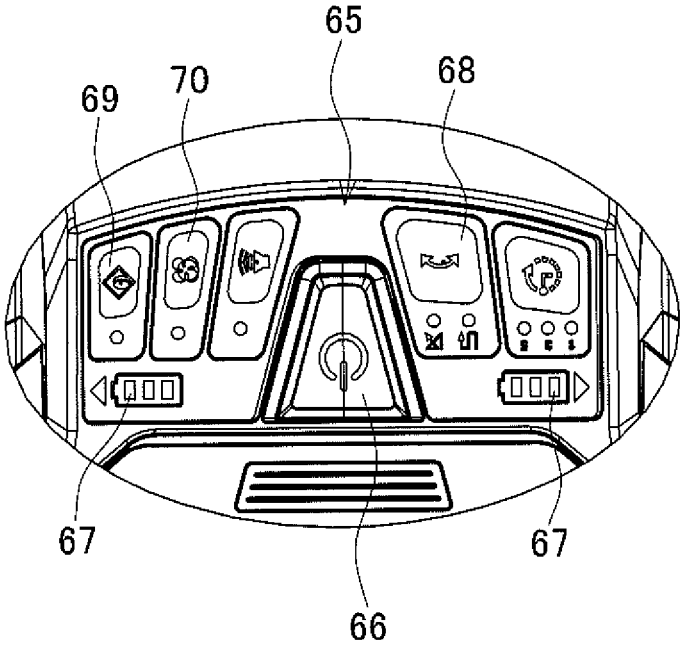
FIG. 7 is an enlarged view of an operation section.

In addition, as shown in FIG. 7, an operation unit 65 is provided on the upper housing 11 in the rear of the lid 41. The operation unit 65 includes, in addition to a power button 66 and remaining battery level indicators 67 for the batteries 3, various operation buttons such as a selection button 68 for a running pattern, a selection button 69 for virtual wall control, a selection button 70 for the suction fan 57, etc. On the lower side of the operation unit 65, a switch board 71 including switches that perform ON/OFF switching in accordance with operations of the respective operation buttons.

A lens 72 for display is provided on the upper housing 11 in the front of the lid 41, and an LED board 73 is provided beneath the lens 72. The LED board 73 includes a plurality of LEDs including a position notification LED 73*a* that emits light beneath the lens 72, and a position notification buzzer. The switch board 71 and the LED board 73 are electrically connected to the control circuit board 64 of the controller 61 through lead wires (not shown).

Figure 8:
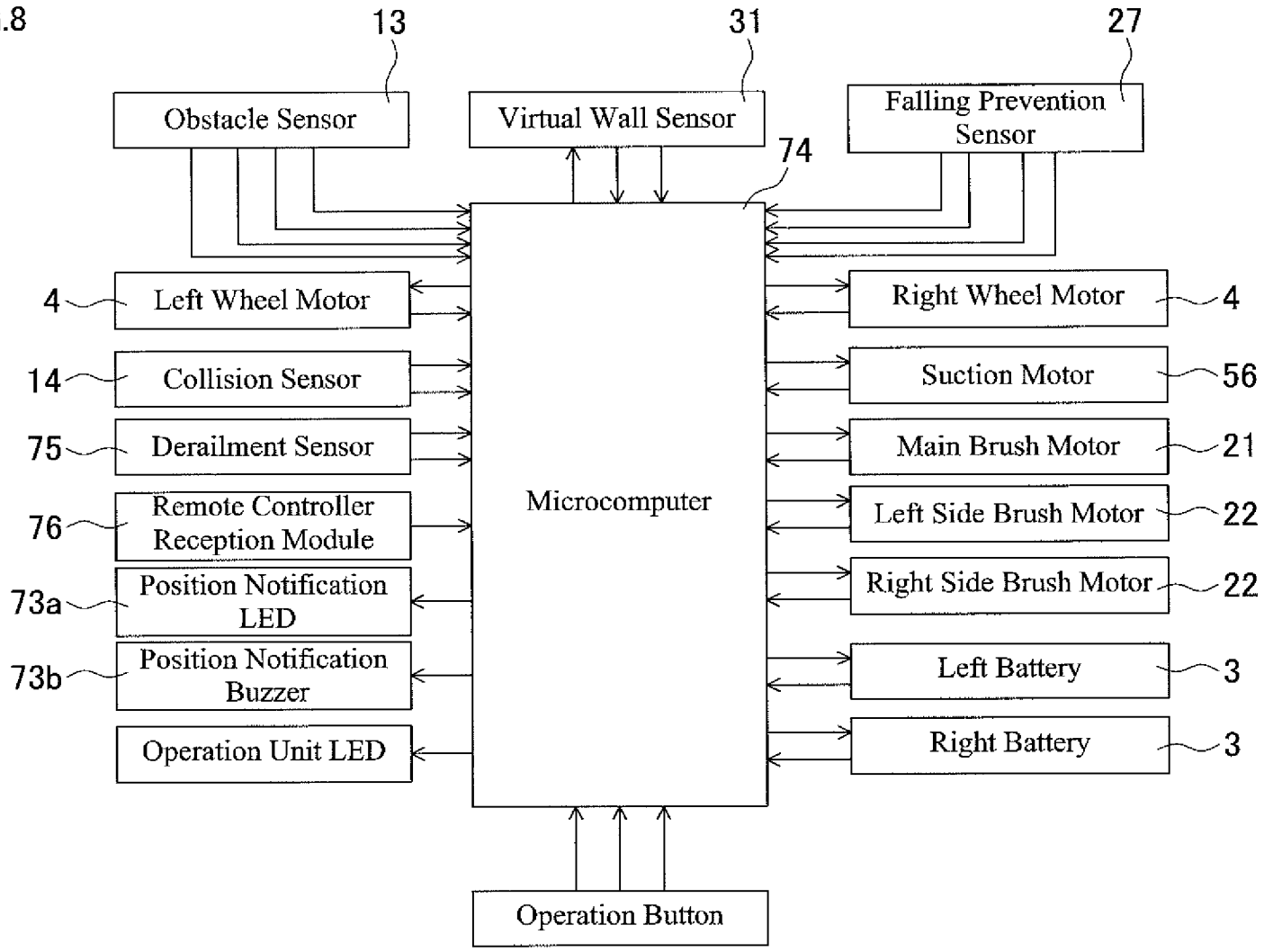
FIG. 8 is a block diagram showing an electrical structure of a controller.

FIG. 8 is a block diagram showing an electric configuration of the dust-collecting robot 1. A microcomputer 74 is mounted on the control circuit board 64 of the controller 61. To the microcomputer 74, detection signals from the aforementioned obstacle sensor 13, infrared sensor 31, falling prevention sensor 27, collision sensor 14, and a derailment sensor 75 are inputted. The derailment sensor 75 is provided in the main body 2 to detect derailment of the wheels 5. It is noted that the infrared sensor 31 outputs an emission command to the infrared transmission element 33. The right and left wheel motors 4 and the respective brush motors 21 and 22 are connected to the microcomputer 74, and the microcomputer 74 outputs control signals to these components, while these components output feedback signals such as current values to the microcomputer 74. From the right and left batteries 3, remaining battery level detection signals as well as power is inputted to the microcomputer 74.

Further, to the microcomputer 74, ON/OFF signals of the respective switches on the switch board 71 are inputted in response to operations of the operation buttons on the operation unit 65, and a reception signal from a remote controller reception module 76 that receives a radio signal from a remote controller (not shown) is inputted. To the switch board 71 and the LED board 73, ON/OFF signals for the respective LEDs including the position notification LED 73*a* and the position notification buzzer 73*b* are outputted.

In the dust-collecting robot 1 configured as described above, in the state where the batteries 3 are mounted on the mount portions 60 and the dust-collecting robot 1 is set on a floor surface, the brush 20 of the main brush 18 and the brushes 26 of the side brushes 23 are in contact with the floor surface. When a user presses the power button 66 on the operation unit 65 to select the operation mode, the wheel motors 4, 4 are driven and the wheels 5, 5 are rotated, whereby the dust-collecting robot 1 runs on the floor surface in accordance with a program installed in a storage section of the microcomputer 74. Simultaneously, the main brush motor 21 and the side brush motors 22 are driven, and the main brush 18 and the side brushes 23 are rotated. Further, the suction motor 56 is driven, and the suction fan 57 is rotated. Thus, dust on the floor surface is swept up by the rotating main brush 18 and is sucked through the suction inlet 16 by a suction power generated by the suction fan 57 to be sent to the dust-collecting box 7 on the rear side. Simultaneously, dust outside the dust-collecting robot 1 is also collected toward the main brush 18 by the side brushes 23, 23.

Then, large dust passes through the lower passage 39, and is stored in the lower dust-collecting room R2 in the box main body 42 from the lower suction inlet 47 of the dust-collecting box 7. Since the lower suction inlet 47 is at a level higher than the bottom surface of the box main body 42 which is the bottom surface of the lower dust-collecting room R2, the dust stored in the lower dust-collecting room R2 is not likely to flow back through the lower suction inlet 47. On the other hand, small dust is captured by the filter 52 and stored in the upper dust-collecting room R1 while the air sucked through the suction inlet 16 passes through the upper passage 38, passes through the upper suction inlet 46 and the upper dust-collecting room R1 as described above, and passes through the filter 52, and then is discharged from the exhaust tube 49 to the fan unit 6. At the lower front side of the filter 52, the lower lid 51 is provided with a guard plate 77 that tilts downward from the front side to the rear side of the filter 52. Therefore, the air is prevented from passing mainly through the front side of the filter 52, and flows toward the center of the filter 52, whereby the filter 52 is not likely to be clogged by the dust. The main brush 18, the side brushes 23, the upper and lower passages 38 and 39, and the dust-collecting box 7 form a dust-collecting unit according to the present invention.

While the dust-collecting robot 1 is running, the obstacle sensor 13 performs detection of obstacle(s) in the running direction in advance, the falling prevention sensor 27 performs detection of presence/absence of the floor surface, the collision sensor 14 performs detection of collision, and the derailment sensor 75 performs detection of derailment, whereby the microcomputer 74 controls the wheel motors 4 so that the dust-collecting robot 1 can run on the substantially flat floor surface on which no obstacle is present.

Among the above-mentioned sensors, since the lens plates 30 of the falling prevention sensors 27 are positioned within the rotation areas E1 and E2 of the side brushes 23 as described above, the rotating brushes 26 are pushed upward by the floor surface and are positioned at a higher level than those shown in FIG. 5 when the dust-collecting robot 1 runs on the floor surface, and thus the brushes 26 are in contact with the lens plates 30. Thus, even if dust or the like adheres to the lens plates 30, the brushes 26 brush off the dust, whereby detection accuracy by the proximity sensor 28 can be maintained.

Meanwhile, the batteries 3, 3 are used in turn one by one as a power supply, and the remaining levels of the batteries 3 are indicated by the remaining battery level indicators 67, 67 provided on the operation unit 65. Therefore, when the remaining level of one of the batteries 3 has become zero first, this battery 3 is disconnected from the mount portion 60 to be charged by an external battery charger. In this case, the dust-collecting robot 1 can be driven by only the other battery 3. Since the casters 8, 8 are provided symmetrically as described above, even if the center of gravity of the main body 2 deviates due to the single battery 3, the right and left casters 8, 8 ensures stable running.

Since the selection button 70 for the suction fan 57 is provided, when the remaining level of the battery 3 is low, this selection button 70 may be switched OFF to halt the operation of the suction fan 57. In the above manner, cleaning can be performed by only the main brush 18 and the side brushes 23, whereby power consumption can be suppressed. A similar selection button is also provided on the remote controller.

When cleaning has finished, if the user does not know where the dust-collecting robot 1 is located, the user presses the position notification button provided on the remote controller. Then, in the dust-collecting robot 1, the notification LED 73*a* is lit up and the lens 72 shines, and simultaneously the position notification buzzer 73*b* sounds. Thus, the user can easily know where the dust-collecting robot 1 is located.

Figure 9:
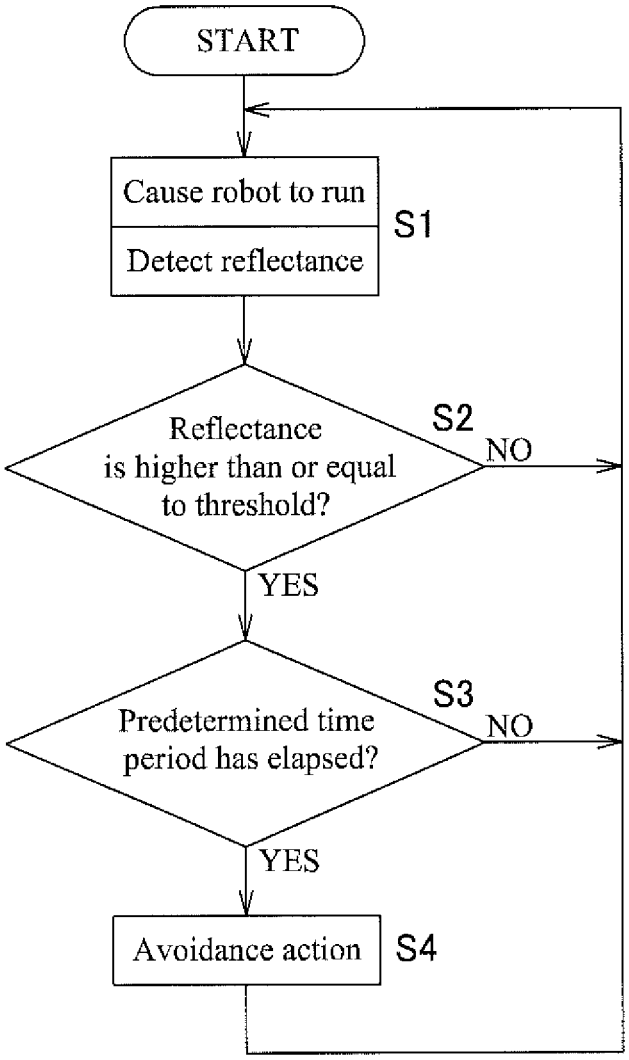
FIG. 9 is a flowchart of a method for controlling running of the self-propelled dust-collecting robot.

In order to define a cleaning range of the dust-collecting robot 1, a tape 80 (see FIG. 10) serving as a reflection member is bonded to the floor surface to set a virtual wall. The tape 80 has, at its front surface, a reflection surface (e.g., silver mirror-printed surface) having an infrared reflectance about 4 to 5 times of a white reflectance, and has a width greater than or equal to 20 mm (the width is 50 mm in this embodiment). Then, the virtual wall selection button 69 on the operation unit 65 is switched ON to select a virtual wall detection mode, whereby running of the dust-collecting robot 1 in accordance with the program is started within the cleaning range defined by the tape 80. Then, as shown in a flowchart of FIG. 9, in step S1, the microcomputer 74 causes the infrared transmission element 33 of the infrared sensor 31 to emit infrared light at predetermined intervals, and causes the infrared reception element 34 to receive the infrared light reflected at the floor surface and detect the reflectance, while causing the dust-collecting robot 1 to run. In step S2, the microcomputer 74 determines whether or not the detected reflectance is higher than or equal to a preset threshold value (twice of the white reflectance in this embodiment). Upon detecting an object (tape 80) having a reflectance higher than or equal to the threshold value, the microcomputer 74, in step S3, determines whether or not a predetermined time period (a few ms) has elapsed from the detection of the high-reflectance object. The reason why elapse of the predetermined time period is confirmed is because erroneous detection should be avoided by reliably detecting only the tape 80 having the width greater than or equal to 20 mm.

Figure 10:
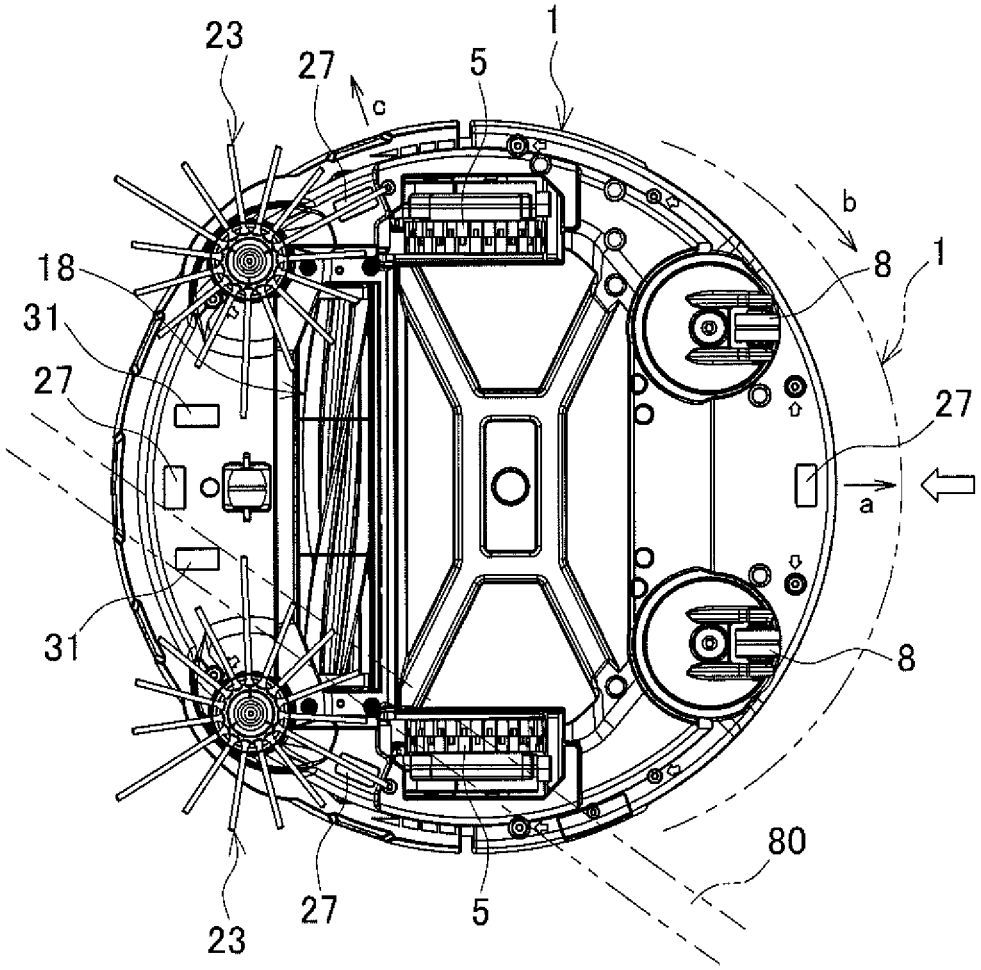
FIG. 10 is an illustrative diagram showing an avoidance action as viewed from the bottom.

When it is determined in step S3 that the time period during which the high-reflectance object is detected has reached the predetermined time period, the microcomputer 74, in step S4, determines that the virtual wall is detected, and controls the wheel motors 4, 4 to cause the wheels 5, 5 to perform an avoidance action set in advance. As shown in FIG. 10, this avoidance action is set in patterns of, for example, once retracting from the detection position of the tape 80 (indicated by an arrow a, an outlined arrow indicates the initial advancing direction), turning at a predetermined angle (indicated by an arrow b), and advancing in a direction where the tape 80 is not present (indicated by an arrow c). After the avoidance action, the process returns to step S1, and running according to the program and detection of the reflectance are continued. When it is determined in step S2 that no high-reflectance object has been detected or when a high-reflectance object has been detected but it is determined in step S3 that the time period during which the detected reflectance is higher than or equal to the threshold value has not reached the predetermined time period, the avoidance action is not performed. In either case, the process returns to step S1, and running and detection of the reflectance are continued. Thus, the dust-collecting robot 1 executes cleaning only in the cleaning range defined by the tape 80.

As described above, according to the dust-collecting robot 1 of the above embodiment and the method for controlling running thereof, the microcomputer 74 of the controller 61, while the dust-collecting robot 1 is running, determines whether or not the reflectance detected by the infrared sensor 31 is higher than or equal to the predetermined threshold value. Upon determining that the reflectance is higher than or equal to the predetermined threshold value, the microcomputer 74 determines that the position where the reflectance is detected is the virtual wall and causes the wheels 5, 5 to perform the avoidance action, thereby causing the dust-collecting robot 1 to perform cleaning in the cleaning range defined by the tape 80.

Particularly in the above embodiment, upon determining that the reflectance is higher than or equal to the threshold value, the microcomputer 74 further determines whether or not the time period during which the reflectance is higher than or equal to the threshold value is longer than or equal to the predetermined time period set in advance. Then, upon determining that the time period during which the reflectance is higher than or equal to the threshold value is longer than or equal to the predetermined time period, the microcomputer 74 causes the wheels 5, 5 to execute the avoidance action. Thus, only the tape 80 that defines the virtual wall can be reliably detected, thereby avoiding erroneous detection.

The number and the location of the infrared sensors are not limited to the above embodiment, and may be changed according to need. The arrangement of the infrared transmission element and the infrared reception element included in each infrared sensor may be changed such that these elements are reversed in the front-rear direction, or are arranged side by side in the right-left direction. Further, the infrared sensors may be provided not only on the bottom surface of the main body but also on a lower surface of a projection projected forward from the main body. Of course, as noncontact sensors, not only infrared sensors but also other photoelectric sensors may be adopted.

The tape is not limited to a tape on which a reflection surface is formed by mirror printing. A thin-plate band-shaped metallic member or the like may be adopted, and the material and the like thereof are not particularly limited. Further, the reflectance and the width of the tape are not limited to the above embodiment, and may be optionally changed as long as the reflectance is twice or more of the white reflectance and the width is greater than or equal to 20 mm. The method of fixing the tape onto the floor surface is not limited to bonding.

The reflection member is not limited to a tape. A cleaning range may be directly defined on a floor surface by, for example, applying a metallic paint with a width greater than or equal to 20 mm on the floor surface, as long as the reflectance twice or more of the white reflectance can be achieved.

Besides, in the dust-collecting robot, the dust-collecting unit does not necessarily have both the main brush and the side brushes. The side brushes may be omitted so that the dust-collecting unit includes only the main brush. Further, the dust-collecting passage is not necessarily branched to the upper and lower passages, and dust may be collected into the dust-collecting box through a single passage. Therefore, any dust-collecting box, such as a dust-collecting box having no tray, can be adopted according to need. The dust-collecting box may be omitted, and dust may be stored directly in the main body.

Furthermore, the number of the batteries is not limited to two, and three or more batteries may be used as long as the batteries can be arranged in a well-balanced manner in the right-left direction. The present invention is also applicable to a self-propelled dust-collecting robot, the advancing direction of which is opposite to that of the above embodiment, that is, in which the batteries and the casters are disposed in the front portion of the main body while the suction inlet is disposed in the rear portion of the main body. In this case, the infrared sensors are disposed in the rear portion of the main body.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A self-propelled dust-collecting robot configured to clean a floor surface comprising:

a light sensor that detects light reflected from a light reflection member and the floor surface; and a control unit that is configured to direct the self-propelled dust-collecting robot away from the light reflection member when the light sensor detects light reflected from the light reflection member as opposed to light reflected from the floor surface;

wherein:

the control unit, while the self-propelled dust-collecting robot is running, determines whether a reflectance sensed by the light sensor is higher than or equal to a predetermined threshold value; and when the control unit determines that the reflectance is higher than or equal to the predetermined threshold value for a time period that is equal to or exceeds a predetermined time period, the control unit directs the self-propelled dust-collecting robot away from the light reflection member.

2. The self-propelled dust-collecting robot according to claim 1, wherein the light reflection member from which the light sensor detects light has a higher light reflection capability than the floor surface.

3. The self-propelled dust-collecting robot according to claim 1, wherein the light sensor is an infrared sensor having an infrared transmission section and an infrared reception section.

4. The self-propelled dust-collecting robot according to claim 1, wherein, when the control unit directs the self-propelled dust-collecting robot away from the light reflection member, the control unit provides instructions for the self-propelled dust-collecting robot to retract from its current position, causing the self-propelled dust-collecting robot to (1) turn at a predetermined angle and (2) advance.

5. The self-propelled dust-collecting robot according to claim 3, wherein a pair of right and left infrared sensors are provided at a foremost position on a bottom surface of a main body having a pair of wheels for running.

6. The self-propelled dust-collecting robot according to claim 5, wherein the infrared sensors each include an infrared transmission element facing downward at a front side of the infrared sensor, and an infrared reception element facing downward at a rear side of the infrared sensor.

7. The self-propelled dust-collecting robot according to claim 5, including, on the bottom surface of the main body, a falling prevention sensor having a lens plate on a detection surface facing downward, and a side brush that includes a plurality of radially-arranged brushes, and rotates, wherein the lens plate is located at a position where, in a plan view, a part or entirety of the lens plate overlaps a rotation area of the brushes of the side brush.

8. The self-propelled dust-collecting robot according to claim 5, wherein the main body has a cylindrical shape in a plan view, and accommodates: right and left batteries; right and left wheel motors that are rotationally driven with the batteries being power supplies, and allow each of the wheels to singly rotate forward and backward; a fan unit disposed between the batteries; and a dust-collecting box.

9. The self-propelled dust-collecting robot according to claim 8, wherein a pair of right and left casters located directly beneath the respective batteries are provided on the bottom surface of the main body.

10. The self-propelled dust-collecting robot according to claim 8, wherein the batteries can also be used as power supplies for power tools.

11. The self-propelled dust-collecting robot according to claim 5, wherein the main body includes a selection button for switching between ON and OFF of detection of the light reflection member.

12. The self-propelled dust-collecting robot according to claim 1, wherein a reflectance of the light reflection member is twice or more of a reflectance of white.

13. The self-propelled dust-collecting robot according to claim 1, wherein the light reflection member is a tape having a width greater than or equal to 20 mm.

* * * * *